US006152095A

United States Patent [19]

Ripma et al.

[11] Patent Number: 6,152,095

[45] **Date of Patent: *Nov. 28, 2000**

[54] QUICK REPLACEMENT SPARK PLUG ASSEMBLY

[75] Inventors: Gordon R. Ripma, Tequesta; William P. Strait, Jupiter, both of Fla.

[73] Assignee: Quik-Change Int'l., L.L.C., Tequesta, Fla.

[ * ] Notice: This patent is subject to a terminal disclaimer.

[21] Appl. No.: 09/414,000

[22] Filed: Oct. 7, 1999

Related U.S. Application Data

[63] Continuation-in-part of application No. 09/006,378, Jan. 13, 1998, Pat. No. 5,979,387, which is a continuation-in-part of application No. 08/749,334, Nov. 14, 1996, Pat. No. 5,706,847.

[51] Int. Cl.[7] ..... H01T 13/08

[52] U.S. Cl. ..... 123/169 R; 123/169 PA; 123/169 EL; 123/142.5 E; 123/143 R; 313/135

[58] Field of Search ..... 123/169 R, 169 PA, 123/169 PH, 169 EL, 169 EB, 169 EC, 142.5 E, 143 R, 143 B; 313/139, 143, 148, 144, 135

[56] References Cited

U.S. PATENT DOCUMENTS

| | | | |
|---|---|---|---|
| 4,327,681 | 5/1982 | Latsch et al. | 123/260 |
| 4,434,758 | 3/1984 | Grammes | 123/286 |
| 4,810,929 | 3/1989 | Strumbos | 313/11.5 |
| 4,814,664 | 3/1989 | Rothenbuhler | 313/131 R |
| 4,972,812 | 11/1990 | Strumbos | 123/169 C |
| 5,280,214 | 1/1994 | Johnson | 313/139 |
| 5,283,499 | 2/1994 | Adam et al. | 313/135 |
| 5,402,637 | 4/1995 | Adam | 60/39.827 |
| 5,430,346 | 7/1995 | Johnson | 313/139 |
| 5,676,100 | 10/1997 | Dam et al. | 123/142.5 E |
| 5,706,847 | 1/1998 | Strait et al. | 123/169 PA |
| 5,834,736 | 11/1998 | Kawamura | 219/270 |
| 5,839,403 | 11/1998 | Grant et al. | 123/169 R |
| 5,862,786 | 1/1999 | Fuchs et al. | 123/142.5 E |
| 5,880,432 | 3/1999 | Radmacher | 219/270 |
| 5,947,071 | 9/1999 | Alcamo | 123/196 EC |
| 5,979,387 | 11/1999 | Strait et al. | 123/169 PA |

*Primary Examiner*—Henry C. Yuen
*Assistant Examiner*—Hieu T. Vo
*Attorney, Agent, or Firm*—Price, Heneveld, Cooper, DeWitt & Litton

[57] ABSTRACT

A two-piece spark plug includes an electrically conductive outer housing including a cylindrical member having an outer wall and an inner wall, the inner wall defining a passage through the outer housing, and a plug member releasably coupled within the outer housing and including an axial electrode and an electrically insulating insulator element encircling the axial electrode, the axial electrode having a first end for connection to an electrical source and a second end for connection within a combustion chamber, and the insulator element having a circumferential first groove and adapted to be positioned within the passage of the outer housing such that a gas-tight seal is formed between the insulator element and the inner wall of the outer housing. The two-piece spark plug further includes a firewall disposed within the first groove and in electrical communication with the outer housing, and an outer electrode in electrical communication with the firewall, the outer electrode cooperating with the second end of the at least one member of the axial electrode to form a spark gap therebetween, and wherein the firewall operates as a heat sink and transfers heat energy from the plug member to the outer housing.

52 Claims, 5 Drawing Sheets

QUICK REPLACEMENT SPARK PLUG ASSEMBLY

CROSS-REFERENCES TO RELATED APPLICATIONS

This invention is a Continuation-In-Part of U.S. patent application Ser. No. 09/006,378, filed Jan. 13, 1998, now U.S. Pat. No. 5,979,387 issued Nov. 9, 1999, entitled QUICK REPLACEMENT SPARK PLUG ASSEMBLY, which is hereby incorporated herein by reference, and which is a Continuation-In-Part of U.S. patent application Ser. No. 08/749,334 filed Nov. 14, 1996, now U.S. Pat. No. 5,706,847 issued Jan. 13, 1998, which is hereby incorporated herein by reference.

BACKGROUND OF THE INVENTION

The present invention relates to spark plugs, and more particularly to spark plugs that may be more rapidly and easily replaced than conventional spark plugs.

Ordinary spark plugs have an external thread on a metal outer shell with a hexagonal head integrally formed with the metal outer shell and adapted for mating with a removal tool such as a socket or box end wrench. The outer shell is seated in a threaded bore of a cylinder head and may have a deformable gasket seal located between the hexagonal head and the cylinder head, thereby isolating the cylinder chamber. Complete sealing and correct positioning of a spark plug in the combustion chamber requires applying a precise torque to the hexagonal head of the spark plug. Excessive torque or incorrect positioning may strip the threads in the cylinder head, requiring expensive repairs. Space for tools is limited in many engine compartments and access is often awkward. All of the problems associated with spark plug replacement are magnified in auto racing competition where engine heat is much greater than with conventional engines and where time constraints are added. Similar problems to those discussed above are associated with the replacement of glow plugs in diesel engine applications and igniters in gas turbine engine applications.

U.S. Pat. No. 5,186,132, issued to Runge teaches a plug-in spark plug that requires a special bore in the cylinder head with a retaining groove for engaging a locking clip. The plug-in spark plug as disclosed in the Runge patent requires some sort of tool fitting in a groove to forcefully pull the plug out and a tool for engaging the clip to reduce its diameter to disengage it from the retaining area. It would be desirable to have a system that would operate with conventionally bored and threaded cylinder heads, since it would be impractical for engine manufacturers to provide special cylinder heads.

U.S. Pat. No. 3,747,583, issued to Georges and Spangler teaches a quick insertion spark plug arrangement in which an outer sleeve screws into the threaded bore in a cylinder head. The sleeve has an inner profile that cooperates with an outer profile of the plug. When in a first rotary position, the plug may be moved axially into and out of the sleeve. When the inserted plug is in a second rotary position, the outer profiles cooperate to lock the position of the plug against axial movement thus preventing the spark plug from being removed from within the sleeve.

Quick disconnect couplings for joining conduits for high pressure fluids are exemplified by U.S. Pat. No. 3,162,470, issued to Davidson, and SWAGELOK (Registered Trademark) fluid flow quick-connect coupling QF series made by the SWAGELOK company of Hudson, Ohio. Each of these couplings as disclosed include a hand-operated sliding lock sleeve that requires no tool for engagement and disengagement. This style of connection has not been applied to spark plugs, glow plugs, or gas turbine igniters.

In a conventional spark plug, the heat range or temperature of the spark plug is primarily a function of the length of the nose of the plug. It would be desirable to design a spark plug that is more efficient at controlling the heat dissipating properties of the spark plug.

SUMMARY OF THE INVENTION

One aspect of the present invention is to provide a two-piece spark plug that includes an electrically conductive outer housing including a cylindrical member having an outer wall and an inner wall, the inner wall defining a passage through the outer housing, and a plug member releasably coupled within the outer housing and including an axial electrode and an electrically insulating insulator element encircling the axial electrode. The axial electrode has a first end adapted for connection to an electrical source and a second end for engagement within the combustion chamber. The insulator element has a circumferential first groove and adapted to be positioned within the passage of the outer housing such that a gas-tight seal is formed between the insulator element and the inner wall of the outer housing. The two-piece spark plug further includes a firewall disposed within the first groove and in electrical communication with the outer housing, and an outer electrode in electrical communication with the firewall, the outer electrode cooperating with the second end of the at least one member of the axial electrode to form a spark gap therebetween, and wherein the firewall operates as a heat sink and transfers heat energy from the plug member to the outer housing.

Another aspect of the present invention is to provide a two-piece spark plug that includes an electrically conductive outer housing including a cylindrical member and at least one bearing member, the cylindrical member having an outer wall and an inner wall, the inner wall defining a passage through the outer housing, and at least one bearing member moveable between a first position and a second position. The two-piece spark plug further including a plug member releasably coupled within the outer housing and including an axial electrode and an electrically insulating insulator element encircling the axial electrode. The axial electrode has a first end for connection to an electric source and a second end for engagement within a combustion chamber. The insulator element having a circumferential first groove adapted to receive the bearing member therein, and the insulator element adapted to be positioned within the passage of the outer housing such that a gas-tight seal is formed between the insulator element and the inner wall of the outer housing. The two-piece spark plug still further including an outer electrode in electrical communication with the outer housing, the outer electrode cooperating with the second end of the axial electrode to form a spark gap between the outer electrode and the second end of the axial electrode, wherein the plug member is locked within the outer housing when the at least one bearing member is in the first position and engages the first groove, and wherein the plug member is removable from within the outer housing when the at least one bearing member is in the second position and is disengaged from the first groove.

Yet another aspect of the present invention is to provide a two-piece spark plug that includes an electrically conductive outer housing including a cylindrical member having an outer wall and an inner wall, the inner wall defining a passage through the outer housing, and a plug member releasably coupled within the outer housing and including an axial electrode, an electrical lead, an electrically insulating insulator element encircling the axial electrode, and an outer electrode. The axial electrode has a first end integrally formed with the electrical lead and a second end adapted for engagement within a combustion chamber. The insulator element is adapted to be positioned within the passage of the outer housing such that a gas-tight seal is formed between the insulator element and the inner wall of the outer housing. The outer electrode is in electrical communication with the outer housing and cooperates with the second end of the axial electrode to form a spark gap between the outer electrode and the second end of the axial electrode.

In another aspect of the present invention, a two-piece glow plug for use in diesel engines and the like, includes an outer housing including a cylindrical member having an outer wall and an inner wall, the inner wall defining a passage through the outer housing, and a plug member releasably coupled within the outer housing and including an axial heating element and a thermally insulating insulator element encircling the axial electrode. The axial heating element has a first end for connection to an electrical source and a second end for engagement within a combustion chamber. The insulator element is adapted to be positioned within the passage of the outer housing such that a gas-tight seal is formed between the insulator element and the inner wall of the outer housing.

Yet still another aspect of the present invention is to provide a two-piece igniter for use in gas-turbine engines and the like, that includes an electrically conductive outer housing including a cylindrical member having an outer wall and an inner wall, the inner wall defining a passage through the outer housing, and an igniter cartridge releasably coupled within the outer housing and including an axial electrode and an electrically insulating insulator element encircling the axial electrode. The axial electrode has a first end for connection to an electric source and an second end for engagement within a combustion area. The insulator element is adapted to be positioned within the passage of the outer housing such that a gas-tight seal is formed between the inner wall of the outer housing and the igniter cartridge.

These and other features, advantages, and objects of the present invention will be further understood and appreciated by those skilled in the art by reference to the following specification and appended drawings.

DETAILED DESCRIPTION OF PREFERRED EMBODIMENTS

Figure 1:
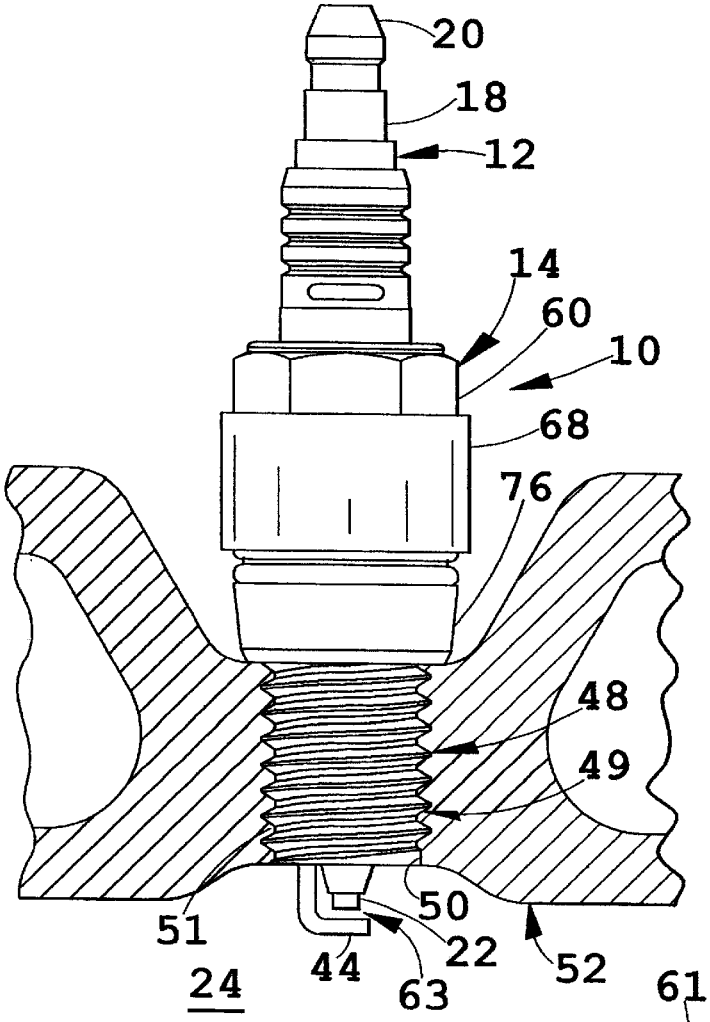
FIG. 1 is a front elevational view of a spark plug of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts of the present invention. Hence, specific dimensions and other physical characteristics relating to the embodiments disclosed herein are not to be considered as limiting.

The reference numeral 10 (FIG. 1) generally designates a two-piece, quick release spark plug embodying the present invention. Spark plug 10 includes a cylindrical plug member 12 and a cylindrical body member 14. Plug member 12 includes a ceramic insulator element 16 (FIGS. 2 and 3) that electrically insulates, supports and surrounds an axial inner electrode 18. Insulator element 16 may alternatively be constructed from insulating materials other than ceramic. A top end 20 of inner electrode 18 is adapted for conventional connection to an electric source (not shown) such as a distributor and a lower end 22 adapted for insertion within the combustion chamber 24 of an internal combustion engine. Insulator element 16 is provided a circumferential annular first groove 28, a circumferential annular second groove 30, a circumferential annular third groove 32, a circumferential annular fourth groove 33, a step wall 34 and a conically shaped lower end 36. Insulator element 16 is constructed of ceramic material having thermal properties sufficient to withstand temperatures normally associated with the cylinder heads of an internal combustion engine. Further, a high tensile strength fiber reinforced ceramic such as NZP commercially available from LoTech, Inc. of Salt Lake City, Utah, is preferrable. Plug member 12 is further provided with a pair of annular heat resistant polymer seals 38 and 40 that are located within first groove 28 and second groove 30, respectively. Seals 38 and 40 may alternatively be constructed from other materials such as synthetic materials and malleable, non-corrosive metals. Alternatively, grooves 28 and 30, and seals 38 and 40 may be replaced with other suitable seal arrangements adequate to prevent the pressure generated within combustion chamber 24 from escaping through spark plug 10.

Figure 4:
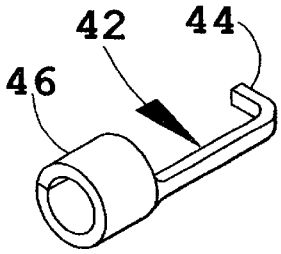
FIG. 4 is a perspective view of a single arm electrode and an associated firewall.

Body member 14 further includes an outer electrode or ground electrode 42 (FIG. 4) that includes a metal tab 44 located at a distal end and a firewall 46 located at a proximal end. Outer electrode 42 is constructed of an electrically and thermally conductive material. Prior to assembly with body member 14, firewall 46 and tab 44 of outer electrode 42 are provided a planar orientation. In assembly, outer electrode 42 is connected with insulator element 16 of plug member 12 by compressing firewall 46 of electrode 42 within third groove 32 of insulator element 16.

Electrically and thermally conductive cylindrical body member 14 (FIG. 1) has an inner portion 48 that cooperates with a bore 50 in a cylinder head 52 to form a gas tight and electrically conductive seal between body member 14 and cylinder head 52. This may be achieved by cooperating internal threads 51 of bore 50 with external threads 49 of inner portion 48. Body member 14 is provided with a hexagonally shaped head 60 that is adapted for mating with a conventional socket or box end wrench for inserting and removing body member 14 from engagement with cylinder head 52. Alternatively, other means well known in the art such as brazing, welding, and the like may be used to secure body member 14 in position within cylinder head 52 as desired, thereby eliminating the need for head 60. It should be noted that this arrangement includes integrally forming body member 14 with cylinder head 52.

Figure 2:
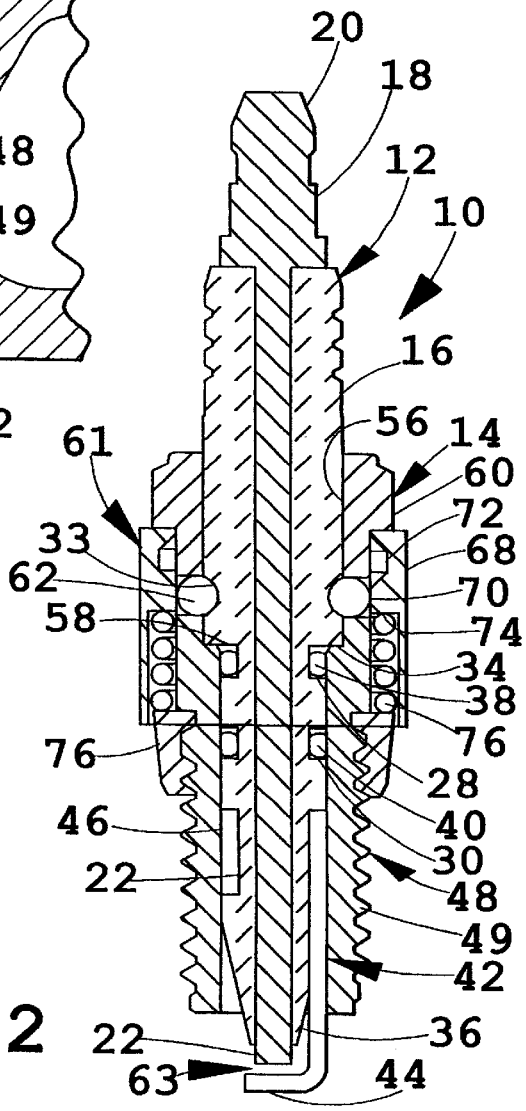
FIG. 2 is a cross sectional view of the spark plug along its longitudinal axis with a release mechanism located in a locked position.
Figure 3:
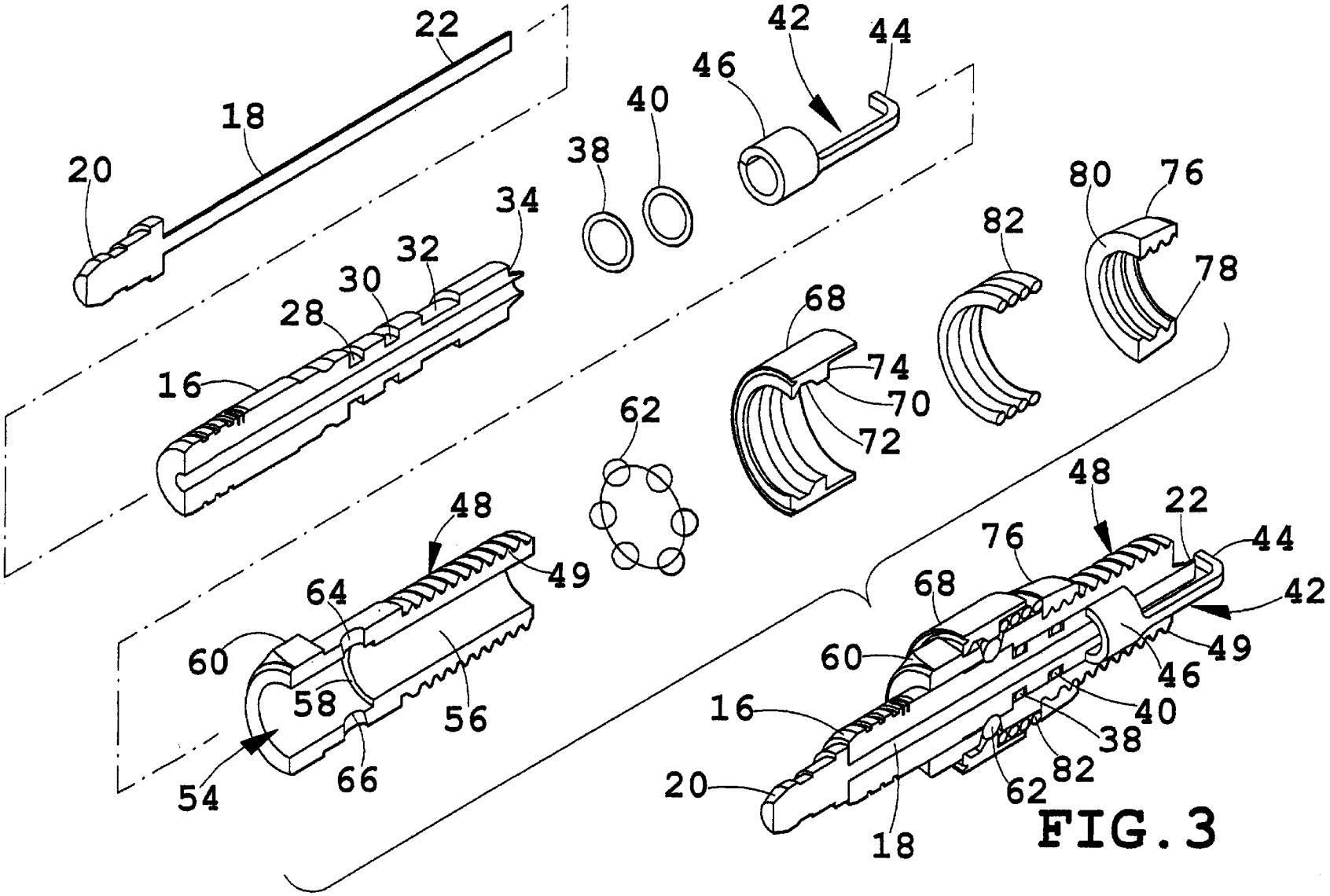
FIG. 3 is an exploded, cross-sectioned perspective view of the spark plug along its longitudinal axis.
Figure 7:
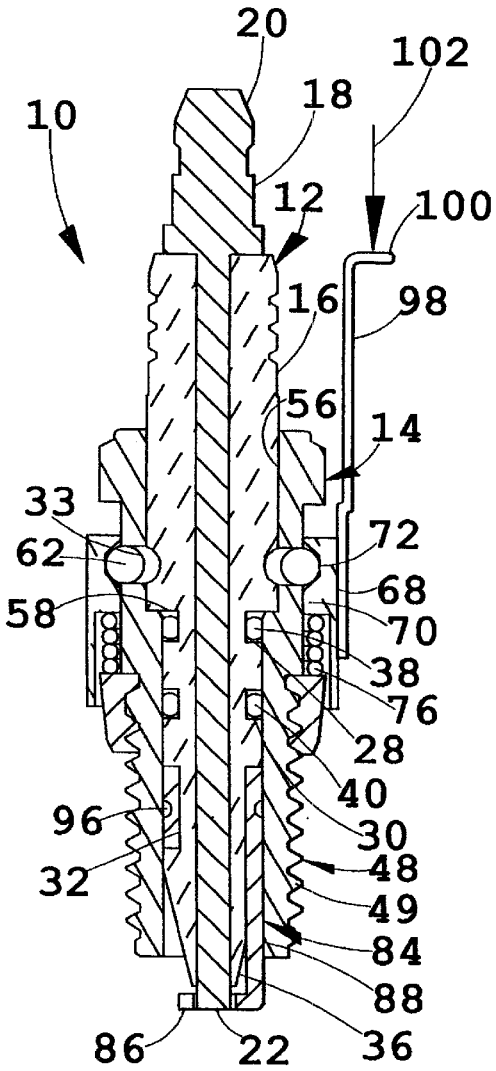
FIG. 7 is a cross sectional view of the spark plug along its longitudinal axis with a lever attached to the disengagement mechanism and the disengagement mechanism in an unlocked position.

Body member 14 (FIGS. 2 and 3) includes an internal passage 54 defining an inner wall 56 and a step wall 58. Body member 14 further includes a quick release mechanism 61 that includes a plurality of hard steel balls 62 located within a series of circumferentially uniformly spaced apart recesses 64 within body member 14 which are open to internal passage 54 and to the outer aspect of body member 14. An aperture 66 on the inner aspect of each recess 64 allows a portion of each ball 62 to protrude therethrough and into internal passage 54 of body member 14. A locking sleeve 68 is telescopingly mounted about body member 14 and reciprocates between an unlocked position, as shown in FIG. 2, and a locked position, as shown in FIG. 7. Locking sleeve 68 is provided with an inwardly radially extending step 70, an inwardly opening circumferential annular groove 72, and a downwardly disposed step wall 74. A retainer ring 76 is provided with internal threads 78 and an upwardly disposed biasing surface 80. In assembly, internal threads 78 of retainer ring 76 are engaged with external threads 49 of inner portion 48 of body member 14, thereby retaining retainer ring 76 about body member 14. A coil spring 82 applies a spring bias between locking sleeve 68 and retainer ring 76 by engaging step wall 74 of locking sleeve 68 and biasing surface 80 of retainer ring 76, thereby forcing locking sleeve 68 into the locked position.

In assembly, plug member 12 is positioned within body member 14 such that balls 62 of the locking mechanism engage fourth groove 33 of body member 14, thereby retaining plug member 12 within body member 14. To remove and replace plug member 12, locking sleeve 68 is manually pushed down until groove 72 of locking sleeve 68 is in alignment with recesses 64, thereby allowing balls 62 to move into groove 72 of locking sleeve 68 and disengage fourth groove 33 of body member 14. Plug member 12 can then be lifted out of body member 14 and replaced without special tools or skills. When a new plug member 12 is fully inserted into body member 14, releasing the locking sleeve 68 locks the plug member 12 in place within body member 14 and lower end 22 of inner electrode 18 within combustion chamber 24 of the internal combustion engine.

Firewall 46 of outer electrode 42 is in thermal and electrical contact with internal passage 54 of body member 14 when plug member 12 is locked within body member 14. A spark gap 63 is formed between lower end 22 of inner electrode 18 and tab 44 of outer electrode 42 when plug member 12 is locked within body member 14. Firewall 46 is compressed within third groove 32 of insulator element 16, thereby allowing for easy insertion and installation of plug member 12 within body 14 of spark plug 10. Firewall 46 acts as a heat sink by transferring the heat collected by outer electrode 84, insulator element 16 and inner electrode 18 to inner wall 56 of body member 14 and cylinder head 52. In addition, firewall 46 isolates those portions of spark plug 10 that are above firewall 46 of outer electrode 42 from the combustion environment or combustion chamber 24. Further, in a conventional plug (i.e., a plug without a firewall 46), the heat range of the spark plug is primarily a function of the length of the nose of the plug. The propagation of heat throughout body member 14, and thus spark plug 10, may be regulated and/or varied by changing the location of firewall 46 along the length of insulator element 16. More specifically, moving firewall 46 changes the overall path the heat dissipation. The greater the distance between the location at which firewall 46 contacts inner wall 56 of body member 14 the slower the rate of heat dissipation, and therefore, the greater the temperature of the plug.

An advantage of the firewall 46 is that the heat transfer characteristics of the plug, or heat range, may be adjusted by changing the location of the firewall 46 along the length of the insulator element 16. Fine tuning of the heat range of spark plug 10 assists in avoiding fouling of electrodes 18 and 84, as well as pre-ignition problems.

Another advantage of firewall 46 is that the heat seal created between firewall 46 and body member 14 assists in isolating those portions of spark plug 10 located above firewall 10 from the heat generated within combustion chamber 24, thereby decreasing heat damage and erosion to those components such as seals 38 and 40.

A further advantage of firewall 46 is that the volume of the combustion chamber may be regulated and/or varied by changing the location of the firewall 46 along the length of insulator element 16, thereby allowing for fine tuning of the volume of the combustion chamber. This fine tuning allows adjustment resulting in greater fuel efficiency for greater gas mileage, and a reduction of pollutants such as nitrogen oxides and CFC's.

Figure 5:
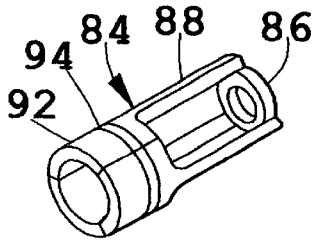
FIG. 5 is a perspective view of a ring-shaped electrode and an associated firewall.
Figure 6:
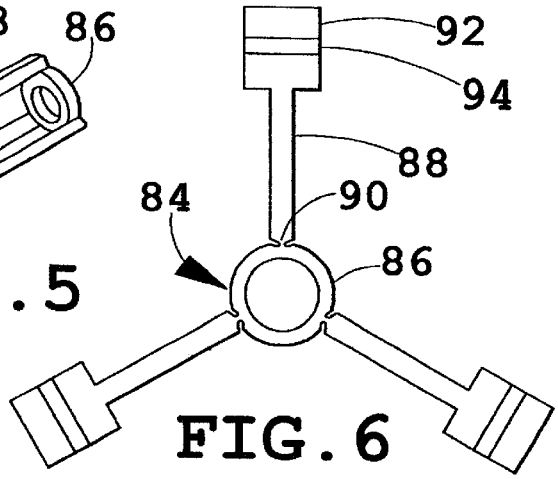
FIG. 6 is a bottom plan view of a ring-shaped electrode and the associated firewall in a planar orientation.
Figure 6A:
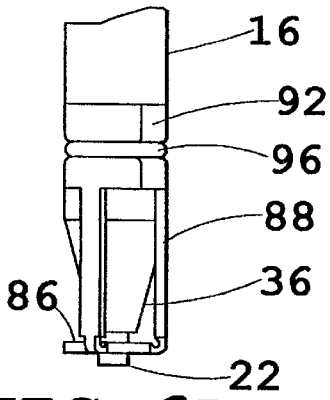
FIG. 6A is a front elevational view of a center electrode with the ring-shaped electrode positioned thereabout.

In an alternative embodiment, spark plug 10 is provided with a ring-type outer electrode 84 (FIGS. 5 and 6). Outer electrode 84 is provided with a ring-shaped electrode 86, three support bars 88 each bendably connected with ring-shaped electrode 86 at a point 90 and spaced equidistant about the outer circumference of ring-shaped electrode 86, and three firewalls 92 each connected to a radial end of a corresponding support bar 88. Each firewall 92 is provided with a centrally located laterally extending channel 94 adapted for receiving a firewall retaining ring 96 (FIG. 6A) therein, as discussed below. Alternatively, firewall 92 can be provided as a single piece attached to ring-electrode 86 by way of a single support bar 88. Prior to assembly, outer electrode 84 is provided in a planar condition with ring-shaped electrode 86, support bars 88, and firewalls 92 lying in a single plane. In assembly, support bars 88 are pivoted about ring-shaped electrode 86 at the corresponding pivot points 90 and firewalls 92 are compressed within third groove 32 of insulator element 16, thereby completely encompassing third groove 32 of insulator element 16 and isolating those portions of spark plug 10 above firewalls 92 from combustion chamber 24. Firewall retaining ring 96 is placed within channel 94 of each firewall 92 thereby retaining each firewall 92 within third channel 32 of insulator element 16.

In another alternative embodiment, an actuator arm 98 (FIG. 7) is fixedly attached to the outer aspect of locking sleeve 68 and is provided with a bent tab 100 on a distal end thereof. Tab 100 is located so as to be easily accessible, thereby allowing a user to place a downward force, as represented by arrow 102, onto tab 100, thereby moving locking sleeve 68 into the unlocked position and allowing plug member 12 to be removed from within body 14.

Figure 10:
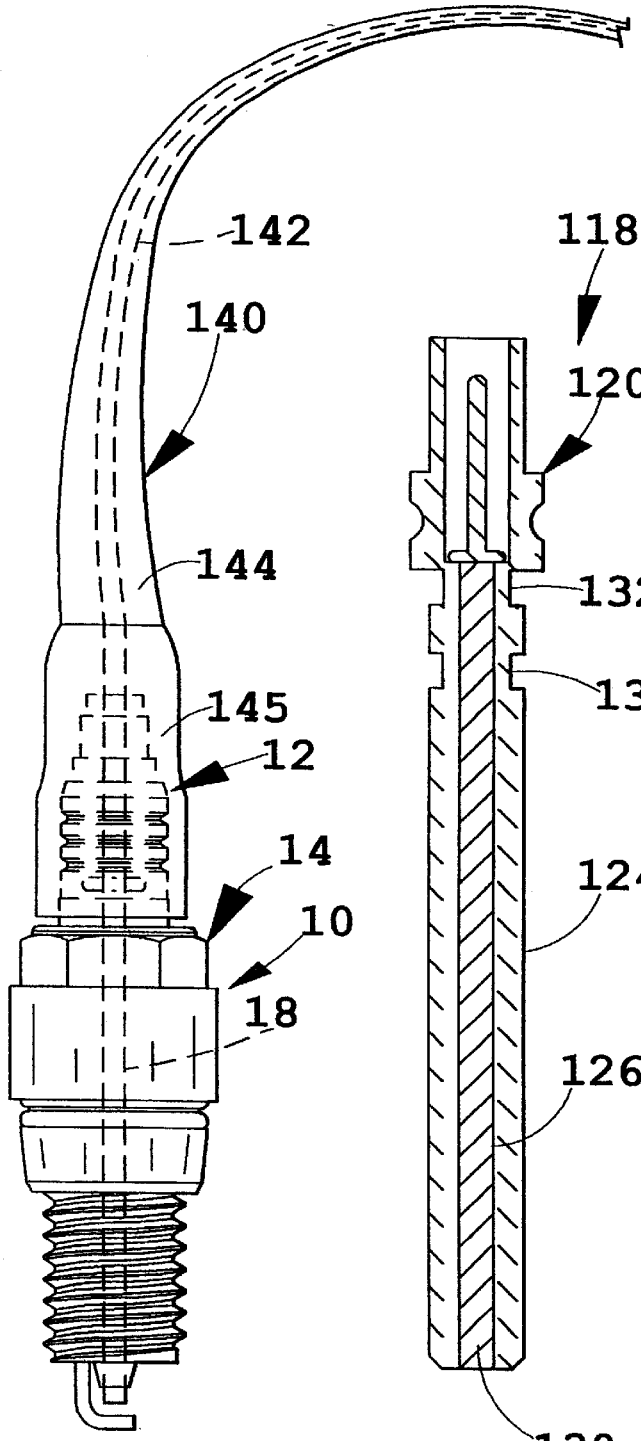
FIG. 10 is a front elevational view of the spark plug and an associated electrical lead.
Figure 9:
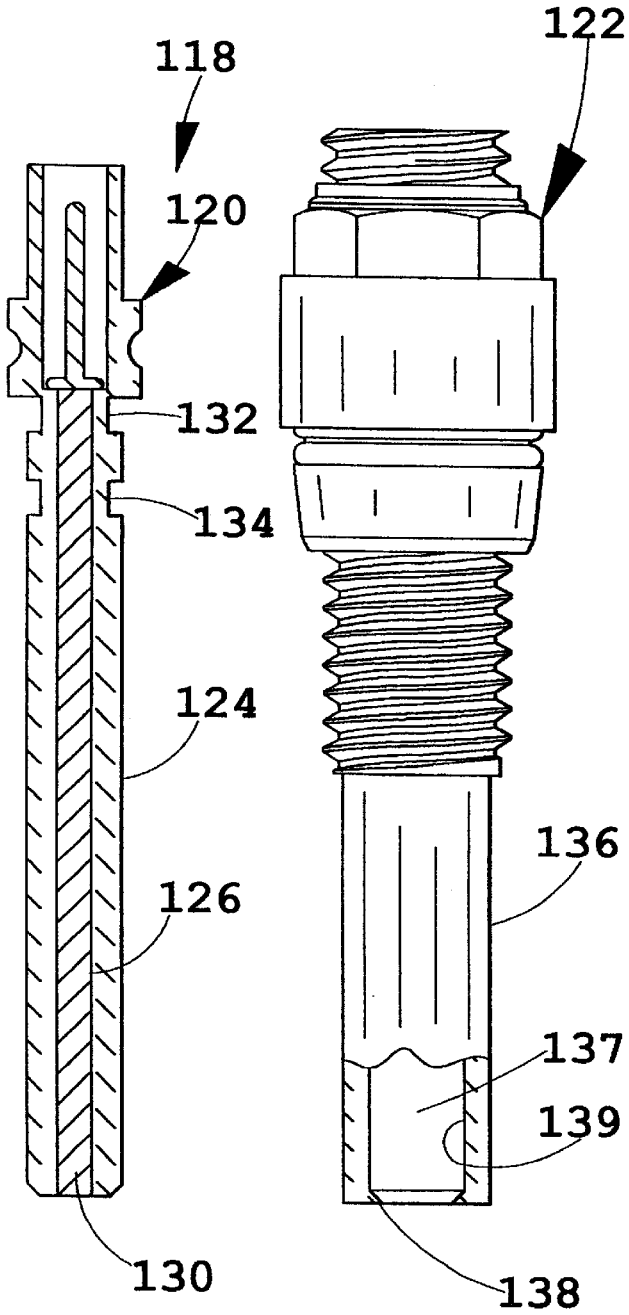
FIG. 9 is a cross sectional view of an igniter.

In yet another alternative embodiment, an electrical lead or spark plug wire 140 (FIG. 10) is permanently affixed to or integrally formed with plug member 12 of spark plug 10.

More specifically, spark plug wire 140 is provided with an interior electrical lead 142, an insulator 144 and a boot 145. Electrical lead 142 of spark plug wire 140 is permanently attached to or integrally formed with inner electrode 18. In addition, boot 145 may be fixedly attached to at least a portion of plug member 12, by applying an adhesive between boot 145 and plug member 12, by overmolding boot 145 onto plug member 12, or by any other suitable means of attachment. Permanently affixing spark plug wire 140 and plug member 12 increases the efficiency of removing and replacing plug member 12 from within body 14 by increasing the ease by which plug member 12 can be grasped and by reducing the number of components that must be removed and replaced when performing spark plug maintenance to the associated engine.

Figure 11:
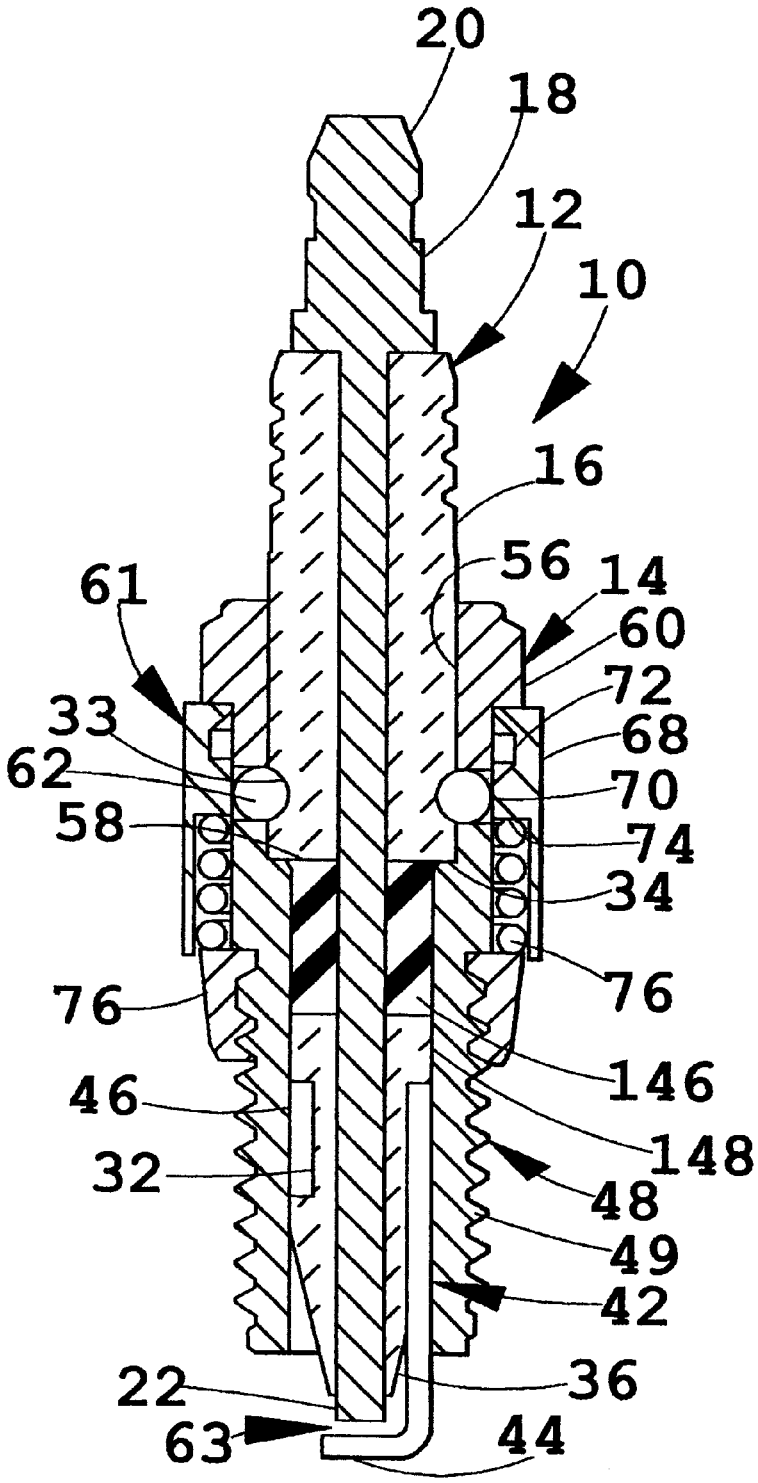
FIG. 11 is a cross sectional view of the spark plug along its longitudinal axis with a shock absorbing seal.

In still yet another alternative embodiment, seals 38 and 40, and first and second grooves 28 and 30 are replaced by a circumferential annular seal 146 (FIG. 11). Annular seal 146 encapsulates the inner electrode 18 and is positioned between insulator element 16 and a lower insulator element 148, and is fixedly attached to insulator element 16 and lower insulator element 148. In assembly, seal 146 is in close contact with inner wall 56 and provides a gas tight seal therebetween, thereby isolating combustion chamber 24 (FIG. 1) from those portions of spark plug 10 located above seal 146. In operation, seal 146 also acts as a shock absorber within spark plug 10.

Figure 8:
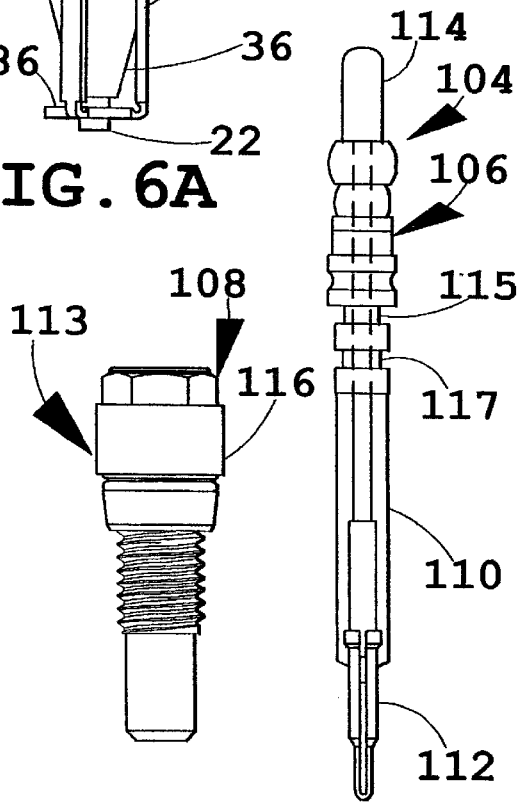
FIG. 8 is a front elevational view of a glow plug.

Although the quick connect spark plug has been explained in connection with a spark plug for use within internal combustion engines, the quick connect adaptation of the spark plug may also be applied to a glow plug 104 for use within diesel engines, as shown in FIG. 8. Similar to spark plug 10 (FIG. 1), glow plug 104 includes a plug member 106 and a body member 108. Plug member 106 is provided with a ceramic insulator element 110, a heating element 112 and an electrical terminal 114. Ceramic insulator 110 is provided with a first circumferential annular groove 115 and a second circumferential annular second groove 117. Preferably, a high tensile strength, fiber reinforced ceramic is used for insulator 110, such as that described above in relation to spark plug 10. A pair of seals (not shown), such as a pair of o-rings, may be placed within the first and second grooves 115 and 117, thereby providing a seal between the combustion chamber of the associated diesel engine and those portions of the glow plug 104 above the o-rings or seal. Grooves 115 and 117 and the associated seals may be replaced with other suitable seal arrangements adequate to prevent the pressure generated within the combustion chamber of the diesel engine from escaping through glow plug 104.

Body member 108 of glow plug 104 is similar in construction to body member 14 of spark plug 10. More specifically, body 108 is provided a quick release mechanism 113 that is similar to quick release mechanism 61 (FIG. 2) of body member 14 of spark plug 10. Quick release mechanism 113 may be moved between locked and unlocked positions, thereby allowing plug member 106 to be assembled to and disassembled from within body 108.

In another application of the quick connect assembly of the present invention, the quick connect assembly is used within an igniter 118 used in conjunction with gas turbine engines. Igniter 118 is provided with a cylindrical igniter member 120 and a cylindrical body member 122. Igniter member 120 is provided with a ceramic insulator element 124 and an axially extending inner electrode 126 having a proximal end 128 adapted for connection with an electrical supply and a distal end 130. Preferably, a high tensile strength, fiber reinforced ceramic is used for insulator 124, such as that described above in relation to spark plug 10. Insulator element 124 is provided with a first circumferential annular groove 132 and a second circumferential annular groove 134. Grooves 132 and 134 are adapted to receive seals therein, thereby preventing the pressure generated within the combustion area from escaping through igniter 118. Grooves 132 and 134 and the associated seals may be replaced with other suitable arrangements adequate to prevent the pressure generated with the combustion area from escaping through igniter 118.

Body member 122 of igniter 118 is provided with a quick-release mechanism similar to body member 14 of spark plug 10 (FIG. 2). Body member 122 is further provided with a metal housing section 136 having an internal passage 137 defining an interior wall 139 and distally located outer electrodes 138.

In assembly, igniter member 120 is located within body member 122 such that distal end 130 of inner electrode 126 is in close proximity to outer electrodes 138 of metal housing 136, thereby allowing a spark to be generated between distal end 130 of inner electrode 126 and outer electrode 138 of metal housing 136.

In the foregoing description, it will be readily appreciated by those skilled in the art that modifications may be made to the invention without departing from the concepts disclosed herein.

What is claimed is:

1. A two-piece spark plug, comprising:

an electrically conductive outer housing including a cylindrical member having an outer wall and an inner wall, said inner wall defining a passage through said outer housing; and a plug member releasably coupled within said outer housing and including an axial electrode, an electrical lead, an electrically insulating insulator element encircling said axial electrode, and an outer electrode, said axial electrode having a first end integrally formed with said electrical lead and a second end for engagement within a combustion chamber, said insulator element adapted to be positioned within said passage of said outer housing such that a gas-tight seal is formed between said insulator element and said inner wall of said outer housing, said outer electrode in electrical communication with said outer housing and cooperating with said second end of said axial electrode to form a spark gap between said outer electrode and said second end of said axial electrode.

2. The two-piece spark plug described in claim 1, wherein said plug member further includes an insulator encircling said first end of said axial electrode and said electrical lead.

3. The two-piece spark plug described in claim 2, wherein said outer housing is adapted to connect with a conventional cylinder head.

4. The two-piece spark plug described in claim 3, wherein said outer wall of said outer housing is threaded.

5. A combination cylinder head and two-piece spark plug, comprising:

a passageway through said cylinder head defined by an electrically conductive wall having at least one engagement member, said passageway receiving a plug, said at least one engagement member movable between a first position and a second position;

said plug member releasably coupled within said passageway and including an axial electrode and an electrically insulating insulator element encircling said axial electrode, said axial electrode having a first end for connection to an electric source and a second end for engagement within a combustion chamber, said insulator element having a circumferential first groove adapted to receive said engagement member therein, said insulator element adapted to be positioned within said passageway such that a gas-tight seal is formed between said insulator element and wall; and an outer electrode in electrical communication with said wall, said outer electrode cooperating with said second end of said axial electrode to form a spark gap between said outer electrode and said second end of said axial electrode; and wherein said plug member is locked within said passageway when said at least one engagement member is in said first position and engages said first groove, and wherein said plug member is removable from within said passageway when said at least one engagement member is in said second position and is disengaged from said first groove.

6. The combination cylinder head and spark plug described in claim 5, further comprising:

a cylindrical part extending upwardly from said cylinder head;

a locking sleeve encircling said cylindrical part, said locking sleeve telescopingly movable along said cylindrical part between a locked position and an unlocked position; and wherein moving said locking sleeve into said locked position requires said at least one engagement member to remain in said first position, and wherein moving said locking sleeve into said unlocked position allows said at least one engagement member to move to said second position.

7. The combination cylinder head and spark plug described in claim 6, further comprising:

a biasing spring biasing said locking sleeve into said locked position.

8. The combination cylinder head and spark plug described in claim 6, further comprising:

an actuator arm fixedly attached to said locking sleeve and extending outwardly therefrom, whereby said locking sleeve is movable between said locked and unlocked positions by placing pressure on said actuator arm.

9. The combination cylinder head and spark plug described in claim 8, further comprising:

a first seal; and wherein said insulator element includes a circumferential second groove adapted to receive said first seal therein, and wherein said first seal is located within said second groove, thereby forming the gas-tight seal between said wall and said plug member.

10. The combination cylinder head and spark plug described in claim 9, further comprising:

a second seal; and wherein said insulator element includes a circumferential third groove adapted to receive said second seal therein, and wherein said second seal is located within said third groove, thereby forming the gas-tight seal between said wall and said plug member.

11. The combination cylinder head and spark plug described in claim 5, further comprising:

a first seal; and wherein said insulator element includes a circumferential second groove adapted to receive said first seal therein, and wherein said first seal is located within said second groove, thereby forming the gas-tight seal between said wall and said plug member.

12. The combination cylinder head and spark plug described in claim 11, further comprising:

a second seal; and wherein said insulator element includes a circumferential third groove adapted to receive said second seal therein, and wherein said second seal is located within said third groove, thereby forming the gas-tight seal between said wall and said plug member.

13. A two-piece spark plug, comprising:

an electrically conductive outer housing including a body member having an outer wall and an inner wall, said inner wall defining a passage through said outer housing;

a plug member releasably coupled within said outer housing and including an axial electrode and an electrically insulating insulator element encircling said axial electrode, said axial electrode having a first end for connection to an electric source and a second end for engagement within a combustion chamber, said insulator element having a circumferential first groove and adapted to be positioned within said passage of said outer housing such that a gas-tight seal is formed between said insulator element and said inner wall of said outer housing;

a firewall disposed within said first groove and in electrical communication with said outer housing; and an outer electrode in electrical communication with said firewall, said outer electrode cooperating with said second end of said at least one member of said axial electrode to form a spark gap therebetween; and wherein said firewall operates as a heat sink and transfers heat energy from said plug member to said outer housing.

14. The two-piece spark plug described in claim 13, wherein said firewall includes at least a first segment and a second segment.

15. The two-piece spark plug described in claim 14, wherein said outer electrode is substantially annularly shaped.

16. The two-piece spark plug described in claim 15, wherein said firewall includes a third segment, said first, second and third segments each extending an equal distance about said insulator element.

17. The two-piece spark plug described in claim 16, wherein said first, second and third segments are each connected to said outer electrode.

18. The two-piece spark plug described in claim 17, further comprising:

a retaining ring; and wherein said first, second and third segments are each provided with a centrally located channel adapted to receive said retaining ring therein, and wherein said retaining ring is located within said channels, thereby retaining said firewall within said first groove.

19. The two-piece spark plug described in claim 18, further comprising:

a first seal; and wherein said insulator element includes a circumferential second groove adapted to receive said first seal, said first seal located within said second groove and forming the gas-tight seal between said plug member and said outer housing.

20. The two-piece spark plug described in claim 19, further comprising:

a second seal; and wherein said insulator element includes a circumferential third groove adapted to receive said second seal, said second seal located within said third groove and forming the gas-tight seal between said plug member and said outer housing.

21. The two-piece spark plug described in claim 20, wherein said outer wall of said outer housing is adapted to couple with a conventional cylinder block.

22. The two-piece spark plug described in claim 21, wherein said outer wall of said outer housing is threaded.

23. The two-piece spark plug described in claim 13, wherein said firewall includes a first segment, second segment and a third segment each extending an equal distance about said insulator element.

24. The two-piece spark plug described in claim 23, wherein said first, second and third segments are each connected to said outer electrode.

25. The two-piece spark plug described in claim 23, further comprising:

a retaining ring; and wherein said first, second and third segments each include a centrally located channel, and wherein said retaining ring is located within said channels of said first, second and third segments, thereby retaining said firewall within said first groove.

26. The two-piece spark plug described in claim 13, further comprising:

a retainer ring; and wherein said firewall includes a circumferential annular groove, and wherein said retainer ring is located within said groove of said firewall, thereby retaining said firewall within said first groove.

27. The two-piece spark plug described in claim 13, further comprising:

a first seal; and wherein said insulator element includes a circumferential second groove adapted to receive said first seal, said seal located within said second groove and forming the gas-tight seal between said plug member and said outer housing.

28. The two-piece spark plug described in claim 27, further comprising:

a second seal; and wherein said insulator element includes a circumferential third groove adapted to receive said second seal, said second seal located within said third groove and forming the gas-tight seal between said plug member and said outer housing.

29. A two-piece glow plug for use in diesel engines and the like, comprising:

an outer housing including a cylindrical member having an outer wall and an inner wall, said inner wall defining a passage through said outer housing; and a plug member releasably coupled within said outer housing and including an axial heating element and a thermally insulating insulator element encircling said axial electrode, said axial heating element having a first end for connection to an electric source and a second end for engagement within a combustion chamber, said insulator element adapted to be positioned within said passage of said outer housing such that a gas-tight seal is formed between said insulator element and said inner wall of said outer housing.

30. The two-piece glow plug described in claim 29, wherein said outer housing further includes an engagement member movable between a first position and a second position, said plug member further includes a circumferential first groove adapted to receive said engagement member therein, and wherein said plug member is retained within said outer housing when said engagement member is in said first position and is engaged within said first groove, and said plug member is removable from within said outer housing when said engagement member is in said second position and disengaged from said first groove.

31. The two-piece glow plug described in claim 30, wherein said outer housing further includes a locking sleeve encircling said cylindrical member and telescopingly moveable along said cylindrical member between a locked position and an unlocked position, wherein moving said locking sleeve into said locked position requires said engagement member to remain in said first position, and wherein moving said locking sleeve into said unlocked position allows said engagement member to move to said second position.

32. The two-piece glow plug described in claim 31, wherein said outer housing further includes a biasing spring biasing said locking sleeve into said locked position.

33. The two-piece glow plug described in claim 32, wherein said outer wall of said outer housing member is adapted to couple with a conventional cylinder block.

34. The two-piece glow plug described in claim 33, wherein said outer wall of said outer housing is threaded.

35. The two-piece glow plug described in claim 34, further comprising:

a first seal; and wherein said insulator element includes a circumferential second groove adapted to receive said first seal, said first seal located within said second groove and forming the gas-tight seal between said inner wall of said outer housing and said plug member.

36. The two-piece glow plug described in claim 35, further comprising:

a second seal; and wherein said insulator element includes a circumferential third groove adapted to receive said second seal therein, said second seal located within said third groove and forming the gas-tight seal between said inner wall of said outer housing and said plug member.

37. The two-piece glow plug described in claim 29, wherein said outer wall of said outer housing is adapted to couple with a conventional cylinder block.

38. The two-piece glow plug described in claim 37, wherein said outer wall of said cylindrical member is threaded.

39. The two-piece glow plug described in claim 29, further comprising:

a first seal; and wherein said insulator element includes a circumferential second groove adapted to receive said first seal, said first seal located within said second groove and forming the gas-tight seal between said inner wall of said outer housing and said plug member.

40. The two-piece plug described in claim 39, further comprising:

a second seal; and wherein said insulator element includes a circumferential third groove adapted to receive said second seal therein, said second seal located within said third groove and forming the gas-tight seal between said inner wall of said outer housing and said plug member.

41. A two-piece igniter for use in gas-turbine engines and the like, comprising:

an electrically conductive outer housing including a cylindrical member having an outer wall and an inner wall, said inner wall defining a passage through said outer housing;

an igniter cartridge releasably coupled within said outer housing and including an axial electrode and an electrically insulating insulator element encircling said axial electrode, said axial electrode having a first end for connection to an electric source and a second end for engagement within a combustion area, said insulator element adapted to be positioned within said passage of said outer housing such that a gas-tight seal is formed between said inner wall of said outer housing and said igniter cartridge.

42. The two-piece igniter described in claim 41, wherein said outer housing further includes an engagement member movable between a first position and a second position, said plug member further includes a circumferential first groove adapted to receive said engagement member therein, and wherein said igniter cartridge is retained within said outer housing when said engagement member is in said first position and is engaged within said first groove and said igniter cartridge is removable from within said outer housing when said engagement member is in said second position and disengaged from said first groove.

43. The two-piece igniter described in claim 42, wherein said outer housing further includes a locking sleeve encircling said cylindrical member and telescopingly moveable along said cylindrical member between a locked position and an unlocked position, wherein moving said locking sleeve into said locked position requires said engagement member to remain in said first position, and wherein moving said locking sleeve into said unlocked position allows said engagement member to move to said second position.

44. The two-piece igniter described in claim 43, wherein said outer housing further includes a biasing spring biasing said locking sleeve into said locked position.

45. The two-piece igniter described in claim 44, wherein said outer wall of said outer housing is adapted to couple with a conventional gas-turbine engine.

46. The two-piece igniter described in claim 45, wherein said outer wall of said outer housing is threaded.

47. The two-piece igniter described in claim 46, further comprising:

a first seal; and wherein said insulator element includes a circumferential second groove adapted to receive said first seal, said first seal located within said second groove and forming the gas-tight seal between said inner wall of said outer housing and said igniter cartridge.

48. The two-piece igniter described in claim 47, further comprising:

a second seal; and wherein said insulator element includes a circumferential third groove adapted to receive said second seal therein, said second seal located within said third groove and forming the gas-tight seal between said inner wall of said outer housing and said igniter cartridge.

49. The two-piece igniter described in cl aim 41, wherein said outer wall of said outer housing is adapted to couple with a conventional gas-turbine engine.

50. The two-piece igniter described in claim 49, wherein said outer wall of said outer housing is threaded.

51. The two-piece igniter described in claim 41, further comprising:

a first seal; and wherein said insulator element includes a circumferential second groove adapted to receive said first seal, said first seal located within said second groove and forming the gas-tight seal between said inner wall of said outer housing and said igniter cartridge.

52. The two-piece igniter described in claim 51, further comprising: a second seal; and wherein said insulator element includes a circumferential third groove adapted to receive said second seal therein, said second seal located within said third groove and forming the gas-tight seal between said inner wall of said outer housing and said igniter cartridge.

* * * * *

UNITED STATES PATENT AND TRADEMARK OFFICE

CERTIFICATE OF CORRECTION

PATENT NO. : 6,152,095
DATED : November 28, 2000
INVENTOR(S) : Gordon R. Ripma and William P. Strait It is certified that error appears in the above-identified patent and that said Letters Patent is hereby corrected as shown below:

Column 13, claim 41,
Line 1; Delete "and the like".

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*